United States Patent [19]

Take et al.

[11] Patent Number: 4,570,593

[45] Date of Patent: Feb. 18, 1986

[54] THROTTLE SAFETY DEVICE

[75] Inventors: Tokio Take, Musashino; Satoshi Sonoda; Takayuki Yamamoto, both of Tokyo, all of Japan

[73] Assignee: Kioritz Corporation, Tokyo, Japan

[21] Appl. No.: 673,435

[22] Filed: Nov. 20, 1984

[30] Foreign Application Priority Data

Dec. 2, 1983 [JP] Japan ..... 58-185780

[51] Int. Cl.[4] ..... G05G 5/04

[52] U.S. Cl. ..... 123/398; 74/526; 123/198 D

[58] Field of Search ..... 123/398, 198 D; 74/501 R, 526

[56] References Cited

U.S. PATENT DOCUMENTS 3,688,599 9/1972 St. Germain ..... 74/526
4,028,804 6/1977 Hammond ..... 123/198 D
4,060,008 11/1977 Wilkinson ..... 74/526
4,278,116 7/1981 Opp ..... 74/526
4,302,880 12/1981 Elfving et al. ..... 123/398
4,337,917 7/1982 Tesack et al. ..... 74/526

FOREIGN PATENT DOCUMENTS 55-142946 11/1980 Japan ..... 123/398

*Primary Examiner*—William A. Cuchlinski, Jr.
*Attorney, Agent, or Firm*—Karl W. Flocks; Sheridan Neimark

[57] ABSTRACT

A throttle safety device including a coil spring mounted on the outer periphery of an operating rod and having one end secured to a fixed part of the device and an opposite end connected to a locking member to resiliently force the latter to move to an operative position. The coil spring is turned into wrapping and pressing engagement with the outer periphery of the operating rod when the locking member is in an inoperative position, so as to hold the latter in the inoperative position.

1 Claim, 3 Drawing Figures

THROTTLE SAFETY DEVICE

BACKGROUND OF THE INVENTION

This invention relates to a throttle safety device for a power-driven machine using an internal combustion engine as a power source.

In this type of machine, a throttle lever is mounted to an operating rod for operating the machine and actuated by the operator to operate a throttle trigger connected to a throttle valve of the internal combustion engine by a Bowden cable. To avoid the internal combustion engine performing an irregular operation as the result of the operator inadvertently touching and moving the throttle trigger, a locking member is provided to automatically lock the throttle trigger except when a regular operation is performed by the internal combustion engine. When this type of throttle lever is used, it has been necessary to provide means for engaging the locking member and informing the operator that the locking member is disposed in an inoperative position.

SUMMARY OF THE INVENTION

This invention has as its object the provision of a throttle safety device for a power-driven machine, simple in construction and low in cost, which obviates the aforesaid disadvantage of the prior art.

The outstanding characteristic of the invention enabling the aforesaid object to be accomplished is a coil spring operative to prevent the excessive movement of the locking member by wrapping and pressing engagement with the operating rod as the locking member is moved to an inoperative position, to thereby automatically limit the movement of the locking member in the inoperative position. The provision of the coil spring eliminates the need to provide additional means for preventing the excessive movement of the locking member from the inoperative position. The throttle safety device according to the invention is simple and compact in construction and easy to handle.

DESCRIPTION OF THE PREFERRED EMBODIMENT

Figure 1:
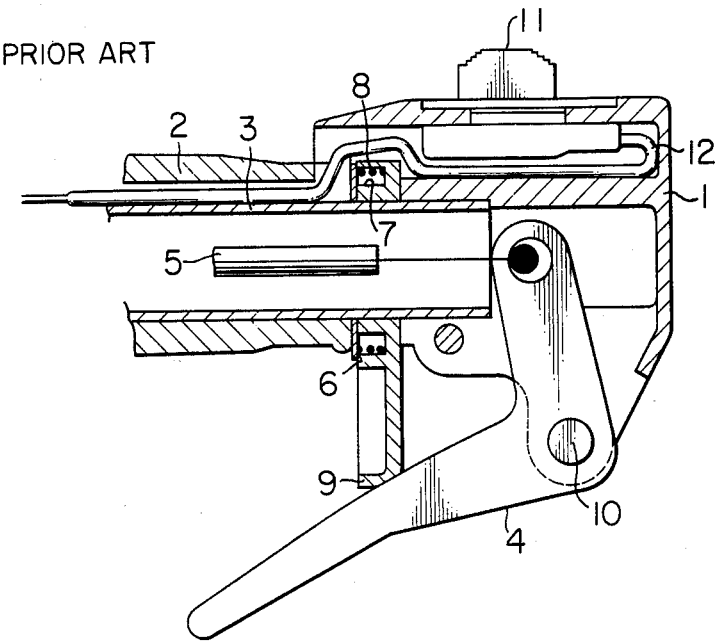
FIG. 1 PRIOR ART
FIG. 1 is a vertical sectional view, with certain parts being broken away, of a throttle safety device of a power-driven machine of the prior art.

Before describing a preferred embodiment of the invention in detail, an example of the throttle safety device of the prior art will be outlined by referring to FIG. 1, to enable the present invention to be thoroughly understood.

A throttle lever includes a main body 1 secured to one end portion of an operating rod 3 having a grip 2 at its outer periphery and having pivotably connected thereto a throttle trigger 4 which has one end of a Bowden cable 5 connected to its inner end. The Bowden cable 5 extends through the interior of the operating rod 3 and is connected at an opposite end thereof to a throttle valve of an internal combustion engine of a power-driven machine. The main body 1 has a locking member 6 pivotably mounted to an outer periphery of the operating rod 3 and formed in a hub thereof with an annular groove 7 having a coil spring 8 mounted therein. The spring 8 is connected at one end to the locking member 6 and at an opposite end to the main body 1 and causes by its biasing force an outer end 9 of the locking member 6 to engage the throttle trigger 4 when the locking member 6 is in an operative position, to avoid a clockwise pivotal movement of the throttle trigger 4 about a pivot 10 in FIG. 1 to prevent the internal combustion engine from accelerating unexpectedly.

When it is desired to accelerate the internal combustion engine, the operator presses the locking member 6 as by the thumb to an inoperative position against the biasing force of the spring 8 to move the outer end 9 of the locking member 6 away from the throttle trigger 4 and allow the latter to move in clockwise pivotal movement in FIG. 1. At this time, it is desirable that the operator be immediately informed that the locking member 6 has moved to the inoperative position. To this end, it has hitherto been usual practice to provide additional means such as a stopper pin limiting the pivotal movement of the locking member 6. In FIG. 1, the numeral 11 designates a switch of the engine which is connected to an electric circuit of the internal combustion engine by wires 12.

Thus, the throttle safety device of the prior art shown in FIG. 1 and described hereinabove requires additional means for ascertaining that the locking member 6 is fully in the inoperative position. This has rendered the construction complex and sometimes caused the device to malfunction due to dust which might adhere thereto.

Figure 2:
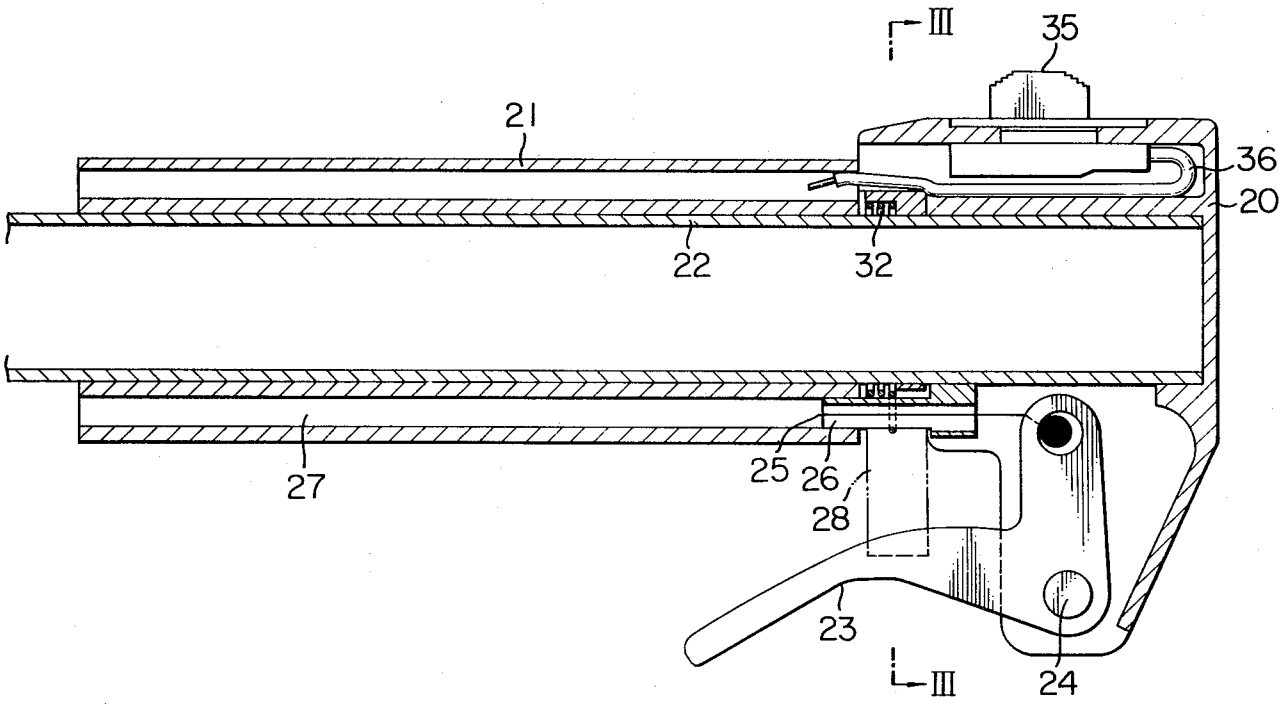
FIG. 2 is a vertical sectional view, with certain parts being broken away, of the throttle safety device for a power-driven machine comprising one embodiment of the invention.

The preferred embodiment of the invention will now be described by referring to FIGS. 2 and 3.

The throttle lever includes a main body 20 secured to one end portion of an operating rod 22 having a grip 21 at its outer periphery. A throttle trigger 23 is pivotably connected to the main body 20 at a pivot 24. The main body 20 may be inserted in an elongated operating rod as of a moving and cutting machine and located in a middle portion thereof. The throttle trigger 23 is located radially outwardly of the operating rod 22 and has connected to an inner end thereof one end of a throttle wire 25 which extends through a tubular wire guide 26 secured to the main body 20 and a Bowden cable bore 27 formed in the grip 21 to be connected at an opposite end thereof to a throttle valve of an internal combustion engine of a power-driven machine.

Figure 3:
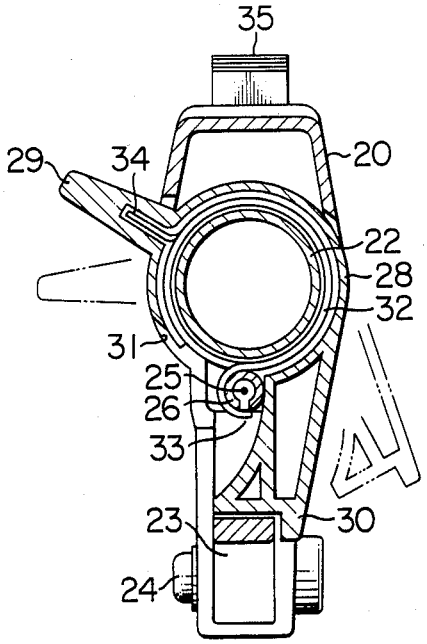
FIG. 3 is a sectional view taken along the line III—III in FIG. 2.

The main body 20 has a locking member 28 pivotably mounted to an outer periphery of the operating rod 22 and includes, as shown in FIG. 3, an operation end 29 manipulated as by the thumb of the operator and a locking end 30 brought into engagement with the throttle trigger 23 to keep the locking member 28 in an operative position. The locking member 28 is formed with an arcuate opening 31 to allow the wire guide 26 to extend therethrough, so that the locking member 28 is movable relative to the main body 20 and wire guide 26 between an operative position indicated by solid lines in FIG. 3 in which the locking member 28 locks the throttle trigger 23 and an inoperative position indicated by phantom lines in FIG. 3 in which it unlocks the throttle trigger 23.

Located adjacent the locking member 28 is a coil spring 32 mounted on an outer periphery of the operating rod 22. As shown in FIG. 3, the spring 32 which is connected at one end 33 thereof to the wire guide 26 is wound in several turns on the outer periphery of the operating rod 22 counterclockwise as seen in FIG. 3 and connected at an opposite end 34 thereof to the operation end 29 of the locking member 28. Thus, when the locking member 28 is in the operative position, the turns of the spring 32 are slightly away from the outer periphery of the operating rod 22 and the spring 32 presses by its biasing force the locking member 28 to move same clockwise in FIG. 3 to bring the locking end 30 of the locking member 28 into locking engagement with the throttle trigger 23 to hold same in the locked position. However, as the locking member 23 is moved to the inoperative position, the turns of the spring 32 are compressed to reduce their diameter and brought into wrapping and pressing engagement with the outer periphery of the operating rod 22, to thereby regulate the movement of the locking member 28 and automatically prevents its further movement.

A switch 35 of the engine and wires 36 perform the same functions as the switch 11 and wires 12, respectively, shown in FIG. 1.

What is claimed is:

1. A throttle safety device comprising:

a main body secured to an operating rod;

a throttle trigger pivotably connected to said main body;

a locking member pivotably mounted to an outer periphery of said operating rod and movable between an operative position in which it is brought into locking engagement with the throttle trigger and an inoperative position in which it is brought out of locking engagement with the throttle trigger; and a coil spring mounted on the outer periphery of the operating rod and having one end secured to a fixed part of the device and an opposite end connected to the locking member to resiliently force the locking member to move to the operative position, said coil spring being turned into wrapping and pressing engagement with the outer periphery of the operating rod when the locking member is in the inoperative position so as to hold the latter in the inoperative position.

* * * * *